United States Patent [19]

Cook

[11] Patent Number: 4,587,925

[45] Date of Patent: May 13, 1986

[54] CONTINUOUS ADHESIVE APPLICATOR

[75] Inventor: Ronald Cook, Marquand, Mo.

[73] Assignee: Tools & Machinery Builders, Inc., Arcadia, Mo.

[21] Appl. No.: 664,251

[22] Filed: Oct. 24, 1984

[51] Int. Cl.[4] ..... B05C 1/02

[52] U.S. Cl. ..... 118/211; 118/232; 118/239; 118/244

[58] Field of Search ..... 118/211, 230, 232, 239, 118/244, 214

[56] References Cited

U.S. PATENT DOCUMENTS 1,965,130 7/1934 Reinhardt ..... 118/232

2,388,911 11/1945 Fink ..... 118/232

*Primary Examiner*—John P. McIntosh

[57] ABSTRACT

A continuous adhesive applicator for applying adhesive, sealant, or the like to cans as they travel along an automated processing line. The apparatus moves the cans through the station area while holding the cans in a selected orientation, rotates the cans as they move through the station, and applies adhesive or the like to a selected portion of each can as it moves through the station. Restraining means, which are cycled for repetitive movement through the station along the path of travel of the line of cans, capture the cans and move them through the station while holding them in the selected orientation.

15 Claims, 9 Drawing Figures

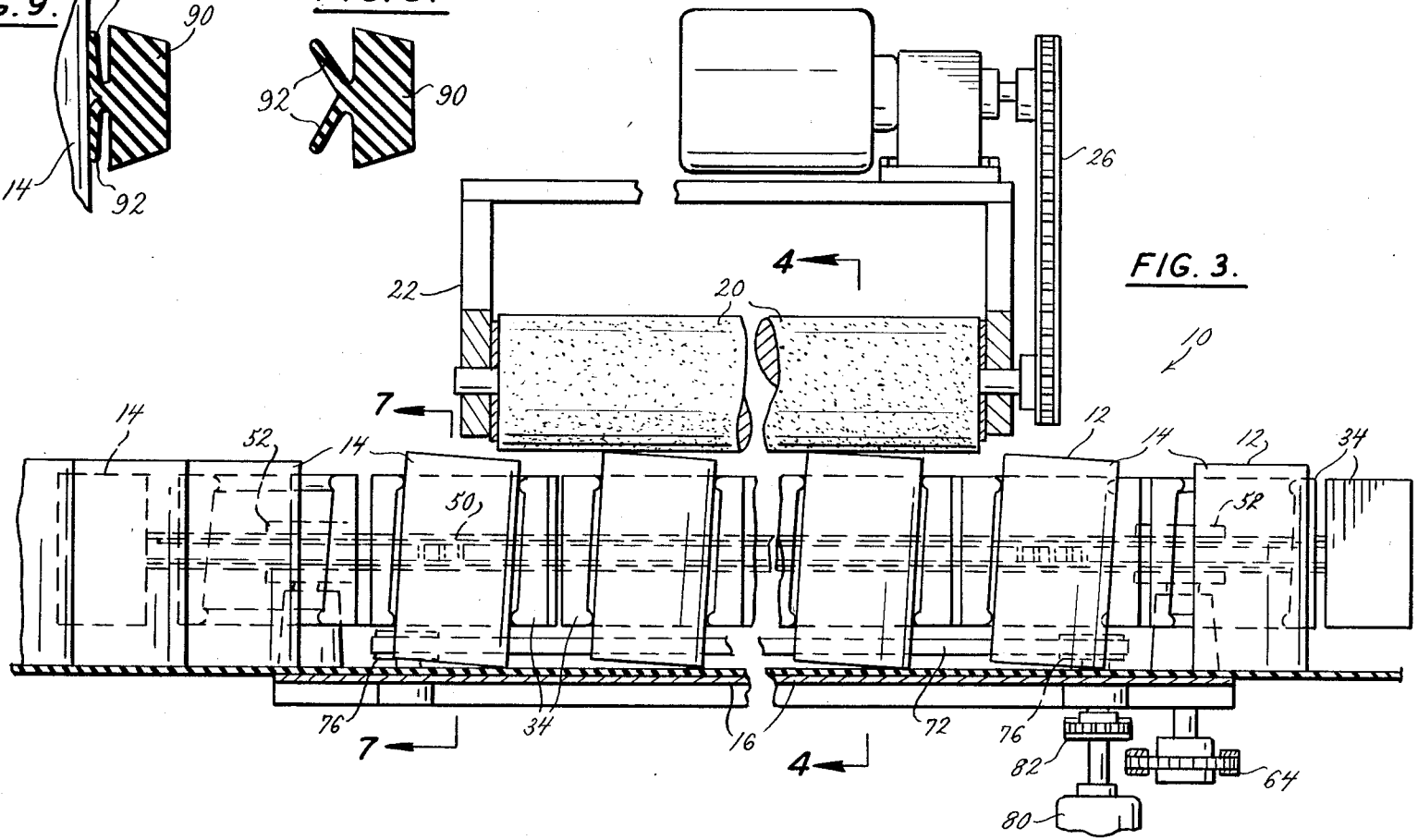
FIG. 3.
10
12
14
16
20
22
26
34
50
52
64
72
76
80
82
4
7
FIG. 8.
90
92
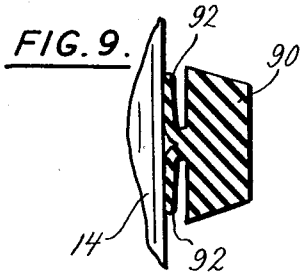
FIG. 9.
90
92
14

CONTINUOUS ADHESIVE APPLICATOR

BACKGROUND AND SUMMARY OF THE INVENTION

This application relates to an apparatus for applying liquid, such as an adhesive or sealant, to the tops of cans or the like, and more specifically to such a device for use in an assembly line to perform this operation at high production. The apparatus of the present invention is particularly adapted for cylindrical cans having walls made of a relatively soft or easily deformed material, such as for example thin wall aluminum cans.

Apparatus of the general type to which the present invention relates is known in the art as exemplified by Cook U.S. Pat. No. 4,413,587. Other patents believed to be less relevant but of general interest are U.S. Pat. Nos. 1,094,139, 2,124,722, 2,388,911, 2,532,914, and 3,695,223. In accordance with the disclosure of U.S. Pat. No. 4,413,587, the cans are moved along a table or slide plate by means of vertically separated timing screws which grip and guide the cans along their path of travel by rotation of the screws. The cans are pressed against the timing screws by contact belts at the opposite sides of the cans, the belts being driven to rotate the cans as they move along their path. The orientation of the cans is adjustable by adjusting the indexing of the two timing screws. In this way the cans can be tilted in a selected position for the application of adhesive at the tops of the cans as explained in the patent. The apparatus and teachings of the referenced patent have proven quite successful with many types of cans. However, the apparatus has some draw backs for use with cans having thin walls or walls of a material that is easily scored or deformed, such as cans of thin wall aluminum. In such applications, the engagement of the timing screws against the cylindrical side walls of the cans required to move the cans linearly along their path of travel, tends to score or deform the walls. This draw back is eliminated with the improvement of the present invention.

In accordance with this improvement the cans are moved or driven along their line or path of travel, and are held in a selected orientation, by restraining means which also move with the cans along the path. Preferably, the restraining means comprise opposing restraining members at each side of the path which are driven on continuous tracks. The opposing members are in registry such they meet at opposite sides of the cans as they enter the apparatus. The opposing members combine to substantially surround the can walls in sufficiently close proximity to hold the can in a selected orientation as it travels along the path and as adhesive is applied to its upper edge. However, the fit between the restraining means and the cans is not so tight as to score or damage the can walls or prevent their rotation. Drive belts at each side of the path engage the cans and cause them to rotate as an adhesive roller applies adhesive to the top edges of the cans.

Hence, a primary objective of the invention is to provide a continuous adhesive applicator which moves the cans along the path of the assembly line and holds them in a selected orientation for application of adhesive to their upper edges without damaging the relatively thin or soft walls of the cans, and without sacrifice in production output. These and other objectives of the invention are apparent from the drawings and detailed description to follow.

DESCRIPTION OF THE DRAWINGS

FIG. 3 is a view in section taken generally along the line 3—3 of FIG. 1;

FIG. 8 is a cross section of the drive belts for rotating the cans (shown not contacting a can); and FIG. 9 is the same view as FIG. 8, but shown in contact with a can.

DETAILED DESCRIPTION OF PREFERRED EMBODIMENT

Figure 1:
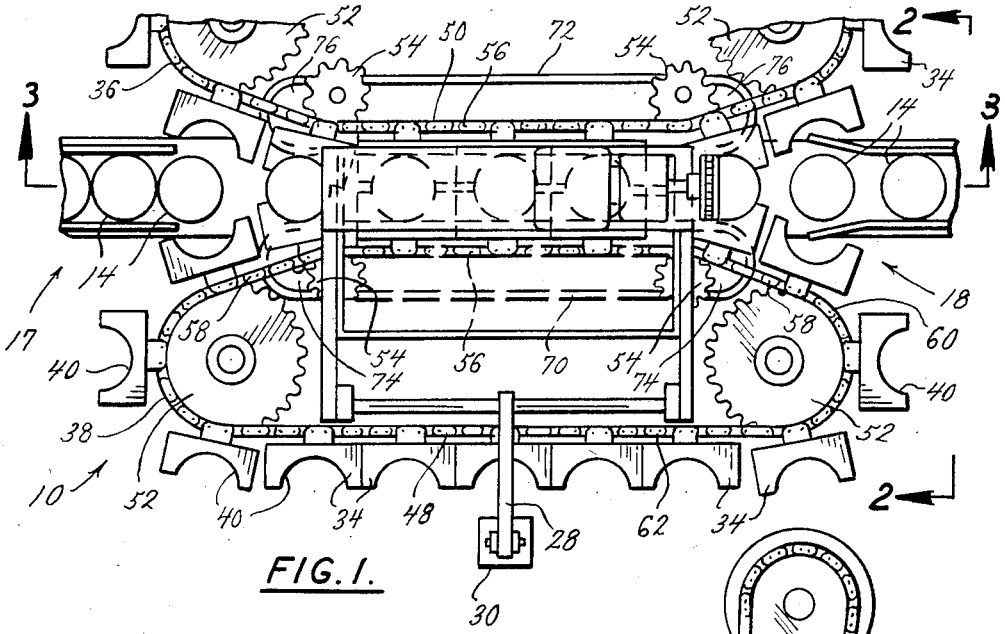
FIG. 1 is a plan view of a continuous adhesive applicator of the present invention with portions broken away for clarity.
Figure 2:
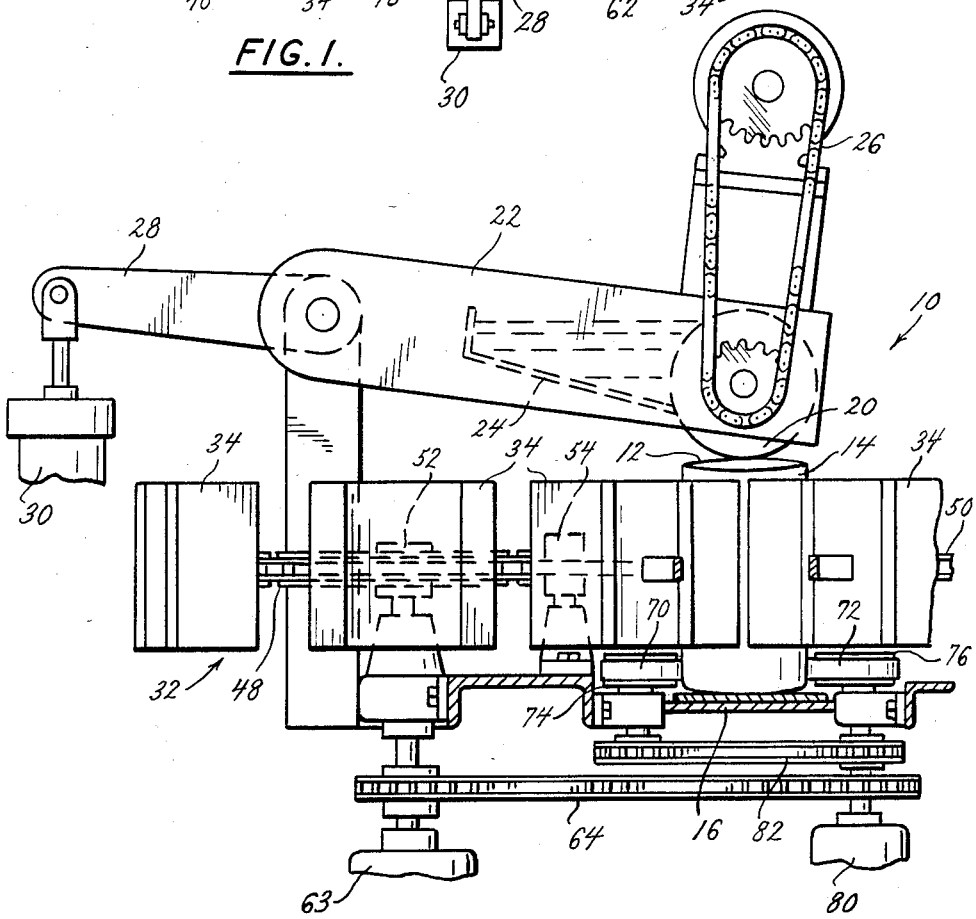
FIG. 2 is a side view taken generally along the line 2—2 of FIG. 1.

With reference to the drawing there is shown a continuous adhesive applicator 10 of the present invention for applying a sealant, adhesive, or the like to the upper edges 12 of a continuous line of cans 14. The present invention is particularly adapted to cans having walls of circular cross section, such as cylindrical walls. The cans are moved in a continuous line on a table 16 to the entrance 17 of the applicator 10, and then move along a generally straight path through the applicator station and exit at 18. The applicator station may be one of several stations along the assembly line that performs automated operations on the cans.

As explained in the referenced Cook patent, the purpose of the applicator is to apply adhesive or the like at the upper edges of the cans as they are moved through the applicator. The cans must be held in a selected orientation in order to apply a bead of adhesive at selected locations at the upper edge. Thus, a bead of adhesive can be applied at either the top, inside, or outside locations at the top edge depending on the orientation of the cans as taught by the reference.

As with the applicator of the referenced Cook patent, as the cans move through the applicator, an adhesive applicator roll 20 applies adhesive to the upper edges of the cans. Adhesive is applied to the roll 20 from a reservoir 22, and the thickness of the adhesive is controlled by the separation between the roll and an adhesive thickness plate 24. The roll 20 is rotated at adjustable speeds, such as through a drive 26, to control the rate of adhesive application, and the applicator roll is vertically adjustable to accommodate cans of various heights and to move the roll into and out of contact with the cans by means of a pivot arm 28 and lift means 30.

With the applicator of the present invention the cans are moved along their path and held in the selected orientation by restraining means 32 which comprise opposing restraining members or blocks 34. The members move on continuous tracks 36 and 38 on opposite sides of the path, and pairs of the members meet in registry on opposite sides of the cans as they enter the applicator to substantially surround and restrain the cans and move them through the applicator station in the selected orientation.

Each restraining member 34 is generally a block having a generally C-shaped or half round cavity 40. At the top and bottom of the cavity are internal shoulders 42 and 44, respectively, of rounded cross section. At the back of the restraining member is a lug 46 mounted to a drive chain. There is one set of blocks or restraining members 34 connected to a drive chain 48 of the track 36, and another set of the blocks 34 connected to a drive chain 50 of the track 38. The blocks are dimensioned and spaced so that they are in close side-by-side proximity along the straight portions of the tracks for maximum productivity.

The tracks 36 and 38 are identical. Each has sprockets 52 at each end with smaller sprockets 54 spaced inwardly therefrom and offset toward the can line. Each track has a straight section 56 between the sprockets 54 directly on opposite sides of and parallel to the path of travel of the cans, sections 58 between the sprockets 54 and 52 which flare away from the path, round end sections 60, and a straight section 62. The tracks 36 and 38 are driven from a common motor 63 and chain drive 64 such that the tracks are driven in opposite directions, the track 36 driven counterclockwise and the track 38 driven clockwise, as viewed in FIG. 1. The tracks are driven at the same speed and are in register so that opposing pairs of restraining members 34 meet in sequence at the entrance of the applicator to capture the cans one after another at the entrance, hold the cans in the selected orientation, and move them along the path through the applicator station as adhesive is applied.

Figure 5:
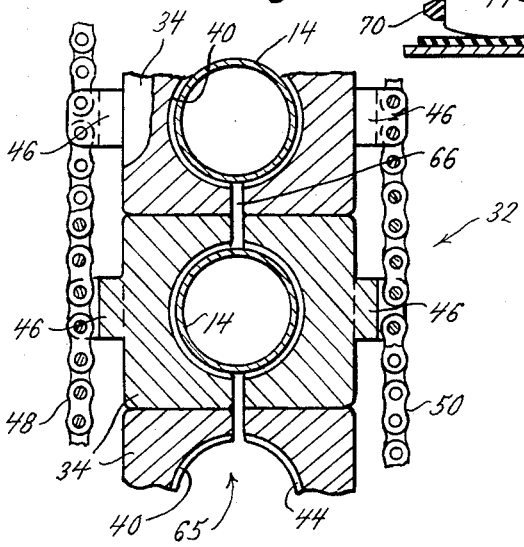
FIG. 5 is a view in section taken generally along the line 5—5 of FIG. 4.
Figure 6:
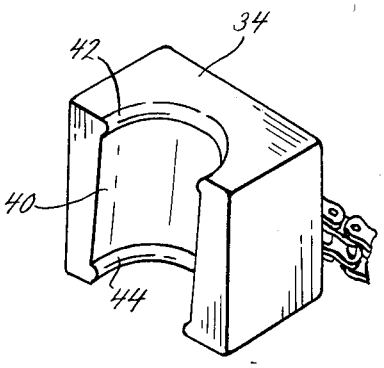
FIG. 6 is a perspective view of one of the restraining members in accordance with the present invention.

Proper orientation for a particular adhesive application requirement is achieved by the configuration of the shoulders 42 and 44 of the members 34. If the shoulders are in vertical alignment, the cans will be held vertically, while if they are offset as shown (FIGS. 3 and 6), the cans will be tilted or oriented (see FIGS. 3, 4, and 7) as determined by the amount of offset. Hence, as an opposing pair of restraining members come together and capture a can, they form a pocket 65 which substantially surrounds the can and holds it in the proper orientation. It will be noted that it is not necessary that the opposing members contact each other as they move the cans along the path, and that in fact in FIG. 5 a clearance 66 is shown between the members. However, the shoulders 42 and 44 of an opposing pair of members should surround the can sufficiently to hold or restrain the can in its proper orientation as the can is rotated and glue applied. The surfaces of the shoulders which contact the can are preferably rounded and of a relatively low friction material such as TEFLON. Also, the fit between the shoulders and the can should be such that the can is held in the proper orientation under the forces applied in moving the can and applying the adhesive, but also so that the can is easily rotated within the pocket.

Figure 4:
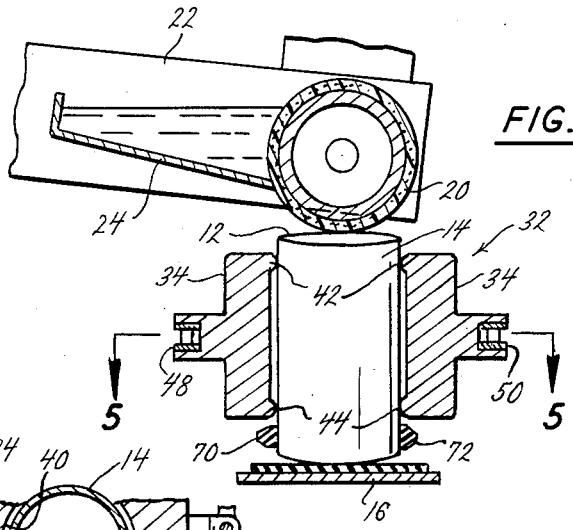
FIG. 4 is a view in section taken generally along the line 4—4 of FIG. 3.
Figure 7:
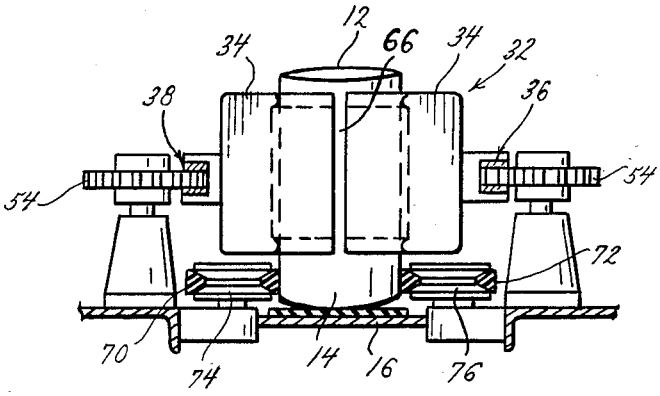
FIG. 7 is a view in section taken generally along the line 7—7 of FIG. 3.

To rotate the cans, drive belts 70 and 72 are located at opposite sides of the path. The belt 70 extends around pulleys 74, and the belt 72 extends around pulleys 76. Preferably, the belts 70 and 72 are driven in the same direction (either clockwise or counterclockwise) so that the portions of the belts that engage the walls of the cans as shown in FIGS. 4 and 7 move in opposite linear directions to rotate the cans. This is achieved by a motor 80 which drives the belts 70 and 72 through a sprocket and chain drive 82. The belts are driven separately from the tracks so that the rate of rotation of the cans relative to their linear speed of travel can be adjusted to regulate the amount of adhesive applied.

With particular reference to FIGS. 8 and 9, there is shown the cross section of the drive belts 70 and 72. FIG. 8 shows the cross section with the belt out of contact with the can, and FIG. 9 shows the cross section with the drive belt contacting the can. Each drive belt includes a tapered portion 90 which seats within the pulleys 74 and 76, and flaired webs 92 extending outwardly therefrom. The belts are made of a suitable elastomeric material such that the webs 92 offer a resilient surface which contact the can walls to impart rotation to the cans without damaging the wall surfaces.

The operation of the applicator is apparent from the foregoing. The tracks 36 and 38 and the belts 70 and 72 are driven as heretofore explained. The cans to which adhesive sealer or the like is to be applied to their upper edges are moved toward the entrance of the applicator, one behind the other, in vertical orientation. As the tracks are driven, the sets of restraining members 34 mounted to the tracks are cycled around the tracks and continuously brought into opposing relationship to capture the cans at the entrance of the applicator. Each pair of opposing members come together at opposite sides of the can to form a pocket within which the can is held and properly oriented. As the opposing restraining members move along the track portions 56 directly on opposite sides of the path, they move the can along the path on the table 16 and hold it in proper orientation throughout as adhesive is applied to the upper edge of the can by the adhesive roller 20. Also, as each can enters the applicator and is moved along the path by the opposing restraining members, the wall of the can is engaged at its lower end on opposite sides by the belts 70 and 72 which impart rotation to the can as its upper edge is contacted by the adhesive roll. At the exit of the applicator, the cans are released from both the belts and the restraining members and continue their movement along the assembly line where further operations are performed.

With the applicator of the present invention the cans are held firmly in proper orientation and moved along their path of travel without damage to the surface of the can walls.

There are various changes and modifications which may be made to applicant's invention as would be apparent to those skilled in the art. However, any of these changes or modifications are included in the teaching of applicant's disclosure and he intends that his invention be limited only by the scope of the claims appended hereto.

I claim:

1. An apparatus for applying a layer of fluid to containers such as cans or the like comprising:

a base, movable restraining means on the base for supporting containers for successive movement in a predetermined processing line of travel past a station, a fluid applying means adjacent the line at the station for contact by parts of the containers as they are transferred along the line, means for rotating the containers in their restraining means as they are moved along the line, holding means in the container restraining means for holding the containers and orienting them at a predetermined angle to the processing line so that parts of the containers contact the fluid applying means during movement and rotation of the containers, and the holding means being positionable to engage the containers at sufficient points around them and that are disposed more than half way around the cans, to confine and prevent the containers from substantial displacement transversely from their oriented positions, but being spaced so as to avoid so tightly contacting them as to subject them to possible deformation or other damage.

2. The improvement of claim 1 wherein said holding means further comprises opposing sets of restraining members, each set mounted on a continuous track, means to drive said tracks to cycle the restraining members through said station and along the line of travel of the cans with the members of one track coming into opposing relationship with those of the other track to form pairs of opposing members capturing the cans therebetween.

3. The improvement of claim 2 wherein each restraining member has a cavity, the cavities of a pair of opposing members defining a pocket within which a can is captured.

4. The improvement of claim 2 wherein each restraining member has engaging means for engaging the side wall of a can, the engaging means of a pair of opposing members engaging said can wall at locations around a substantial portion of the can and holding the can in said selected orientation.

5. The improvement of claim 4 wherein said engaging means comprise vertically spaced inwardly extending shoulders which conform to the can surface and which combine with the shoulders of an opposing member to extend around a substantial portion of the can, the orientation of the can determined by the amount of offset of said shoulders.

6. The improvement of claim 4 wherein the surface of the engaging means is of a low friction material.

7. The improvement of claim 1 wherein the fit between the engaging means and can wall allows ease of rotation of the can while holding the can in the selected orientation as adhesive is applied.

8. The improvement of claim 1 wherein the fluid applying means comprises a rotating roll for applying adhesive, and said adhesive or the like is applied at the upper edges of said cans by contact from a rotating adhesive roll.

9. The improvement of claim 1 wherein said means imparting rotation to said cans further comprises continuous belts having sections extending along the path of travel of the cans and contacting the side walls of the cans as they move through the station, the belts being driven to impart rotation to the cans as they move therepast.

10. The improvement of claim 9 wherein said belts have a resilient web contacting said can walls.

11. The improvement of claim 10 wherein said belts have flared webs for contacting said can walls and for providing a resilient surface for engaging said can walls for imparting rotation to said cans upon driving said belts.

12. In an apparatus for the continuous application of adhesive, sealant, or the like to cans as they travel along an automated processing line, the apparatus having means for moving the cans through a station area while holding the cans in a selected orientation, means for rotating the cans as they move through the station, and means for applying adhesive or the like to a selected portion of each can as it moves through the station, said means for moving the cans comprising:

opposing sets of restraining members, each set mounted on a continuous track with a portion of the track extending along the line of travel of the cans, means to drive said tracks to cycle the restraining members through said station with the members of one track coming into opposed relationship with those of the other track to form pairs of opposing members capturing the cans therebetween, each member having a cavity therein which mates with the cavity of an opposing member to define a pocket for capturing a can, and holding means within each of said pockets for engaging the side wall of a can and holding the can in the selected orientation while allowing rotation of the can within said pocket, said pairs of opposing members moving said cans through said station as they are rotated and as adhesive is applied.

13. The improvement of claim 12 wherein said means imparting rotation to said cans further comprises continuous belts having sections extending along the path of travel of the cans and contacting the side walls of the cans as they move through the station, the belts being driven to impart rotation of the cans as they move therepast.

14. The improvement of claim 12 wherein the adhesive or the like is applied at the upper edges of said cans by contact from a rotating roll, said roll aligned with its length dimension above and along the path of the cans.

15. The improvement of claim 12 wherein each restraining member has holding means for engaging the side wall of a can, the holding means of a pair of opposing members engaging said can wall at locations around a substantial portion of the can and holding the can in said selected orientation, the fit between the holding means and can wall allowing ease of rotation of the can while holding the can in the selected orientation as adhesive is applied.

* * * * *